US007166936B2

(12) United States Patent
Larsson et al.

(10) Patent No.: US 7,166,936 B2
(45) Date of Patent: Jan. 23, 2007

(54) METHOD AND AN APPARATUS FOR CONTROLLING AN ELECTRIC SWITCHING DEVICE

(75) Inventors: Per Larsson, Vastersas (SE); Magnus Backman, Vasteras (SE); Lars Jonsson, Vasteras (SE)

(73) Assignee: ABB Group Services Center AB, Vasteras (SE)

( * ) Notice: Subject to any disclaimer, the term of this patent is extended or adjusted under 35 U.S.C. 154(b) by 672 days.

(21) Appl. No.: 10/297,403

(22) PCT Filed: Jun. 7, 2001

(86) PCT No.: PCT/SE01/01265

§ 371 (c)(1),
(2), (4) Date: Apr. 7, 2003

(87) PCT Pub. No.: WO01/95356

PCT Pub. Date: Dec. 13, 2001

(65) Prior Publication Data

US 2004/0090720 A1 May 13, 2004

(51) Int. Cl.
*H01H 7/00* (2006.01)

(52) U.S. Cl. ..... 307/141
(58) Field of Classification Search ..... 307/141
See application file for complete search history.

(56) References Cited

U.S. PATENT DOCUMENTS 5,793,594 A * 8/1998 Niemira et al. ..... 361/93.2
6,426,634 B1 * 7/2002 Clunn et al. ..... 324/536

* cited by examiner

*Primary Examiner*—Robert L. Deberadinis
(74) *Attorney, Agent, or Firm*—Dykema Gossett PLLC

(57) ABSTRACT

An apparatus for controlling an electric switching device (1) for alternating current arranged in a current path for opening the switching device and for breaking the current in the current path after occurrence of a fault current comprises members (15) adapted to detect the current in the current path and a unit (20) adapted to control the electric switching device to break the current in the current path directly after a half wave of the alternating current having a peak value below a predetermined current limit value, so that the breaking is completed through a zero-crossing of the alternating current terminating a said half wave.

31 Claims, 6 Drawing Sheets

METHOD AND AN APPARATUS FOR CONTROLLING AN ELECTRIC SWITCHING DEVICE

FIELD OF THE INVENTION AND PRIOR ART

The present invention relates to an apparatus for controlling an electric switching device for alternating current arranged in a current path for opening this device for breaking the current in the current path after occurrence of a fault current in the current path as well as a method for such a control.

Such apparatuses and methods are applicable to all types of fields of use of an electric switching device for breaking a current path upon occurrence of fault currents, such as for example in switch gears for electricity supply within the industry or in distribution or transmission networks. When such a fault current occurs, it is important on one hand to open the electric switching device so that the current is broken as soon as possible in order not to damage different types of equipment connected to the current path, but it is on the other absolutely necessary that the alternating current may shift direction, i.e. has a zero-crossing before it is broken. However, the alternating current receives upon occurrence of said fault usually a direct current component (dc-component), the magnitude of which is dependent upon the phase position of the voltage and the load at the time for the occurrence of the fault, and this dc-component is superposed on the alternating current, which in the worst case may mean that it will take several periods of the alternating current before any zero-crossing occurs in the case that the amplitude of the alternating current decreases. "Electric switching device" is to be given a broad sense and does not only cover such ones having mechanical movement between two different parts for obtaining an opening through physical separation of two parts in the current path, but also semiconductor devices, such as IGBT's or the like, which open by entering a blocking state and thereby breaking the current therethrough. "Electric switching device" also comprises so-called transfer switches through which then a current in a current path may be broken upon occurrence of a fault current in the current path for instead switching in another current path to a load or the like.

It is schematically illustrated in FIG. 1 how in the case of a purely inductive load the voltage U and the current I in the current path are displaced 90° with respect to each other. We now assume that a short-circuiting along the current path occurs at the time $t_1$, when the voltage is at maximum and the current zero. This means then that a current $I_1$ being symmetric with respect to the zero line and having a certain ac-decay, i.e. an amplitude decreasing with time, is obtained after the fault. However, should the short-circuiting occur at the time $t_2$, when the voltage U is zero and the current I is a maximum, a maximum asymmetry will then result, i.e. the dc-component of the current $I_2$ gets a maximum. This dc-component has also a decay with time. However, should the decay of the dc-component be slower than the ac-decay initially existing it could take a not negligible period of time before a zero-crossing is obtained and a breaking of the fault current may be achieved.

FIG. 2 illustrates somewhat more in detail how the total current $I_{tot}$ may develop over time t for a fault case with a maximum asymmetry and how the dc-component then decreases with time. Typically, this sinks to about ⅓ during 3 periods of the alternating current.

A disadvantage of such an asymmetry of the alternating current is also that it has until now been necessary to take into account that the breaking may possibly take place during the so-called "long half wave" of the alternating current, i.e. the breaking is completed at a zero-crossing following upon a half wave of the current having the highest peak value, so that the electric switching device has to be dimensioned for taking very high peak currents possibly existing. A possibility to do without any such dimensioning of the switching device is to introduce a considerable delay, maybe 3–4 periods of the alternating current, before the breaking takes place, so that the dc-component has time to decrease sufficiently. Thus, it has until now after occurrence of a fault quite simply been waited so long that a breaking completely surely may be made in connection with a zero-crossing of the alternating current, in which it is then presumed that the fault may have occurred at the most unfavourable time with respect to the dc-component, and the dc-component has fallen to a comparatively low level. This long wait of course means imminent risks of greater damage on said equipment than could the breaking take place at an earlier time. In this way to proceed for breaking the alternating current the breaking may in most cases take place after occurrence of several zero-crossings, since there has to be a substantial safety margin against breaking too early. However, this long breaking time is sometimes far too long, for example when there is a substantial symmetry of the current directly after occurrence of said fault current.

It would therefore be desired to break the alternating current considerably earlier exactly when this is possible.

It is pointed out that the invention is applicable to opening of current paths provided with all types of electric switching devices, since it is interesting to obtain a well controlled arcing time, but nevertheless not break the current unnecessarily late, for conventional breakers, but the invention is quite particularly directed to so called hybrid breakers of the type described in for example the Swedish patent application 9904164-2 of the applicant still not available to the public. In such a hybrid breaker having two branches connected in parallel in the current path, one in the regular current path through the switching device with a commutator, and one with a part with ability to block current therethrough in at least one blocking direction and conduct current therethrough in at least one direction, and a breaking contact member connected in series with said part, it is of great interest to be able to control the contact opening of the commutator so that a well controlled small spark is obtained at the commutation. Since said part has to block so that a breaking of the current through the contact member may take place at zero-current it is when using a said part in the form of rectifying diodes a condition that the commutator is not opened until a zero-crossing of the alternating current may be obtained. The diode has either to be dimensioned to take a comparatively high possible current therethrough should the commutation and thereby also the breaking take place comparatively rapidly after occurrence of the fault current, which results in a costly diode, or a considerable delay of the breaking of the current after occurrence of the fault current with the disadvantages connected therewith already mentioned have to be accepted. The corresponding problem is also applicable to an electric switching device according to the applicant's Swedish patent application 9904166-7 still not available to the public.

SUMMARY OF THE INVENTION

The object of the present invention is to provide an apparatus and a method of the type defined in the introduction, which make it possible to break the current in said current path at a point of time being as far as possible an optimum for each individual case.

This object is according to the invention obtained by providing such an apparatus with members adapted to detect the current in the current path and a unit adapted to control the electric switching device to break the current in the current path directly after a half wave of the alternating current having a peak current below a predetermined current limit value, so that the breaking is completed at a zero-crossing of the alternating current terminating a said half wave.

By in this way detecting the current and making the breaking of the current in the current path dependent upon the peak current of the alternating current during the half wave preceding the completing of the breaking, it will be possible to break the current in the current path as soon as this may be allowed at all, so that the breaking does not have to be delayed more than required in each individual case. This means that for a conventional breaker no delay has to be introduced for a symmetric current or lower currents, so that a short breaking time may be obtained.

According to a preferred embodiment of the invention the apparatus comprises means adapted to determine a peak current value of two consecutive half waves of the alternating current after occurrence of a fault current on the basis of values of the current obtained through said current detection and compare these peak current values with each other, and the unit is adapted to control the switching device to break the-current in the current path during a half wave of the alternating current corresponding to said half wave and having the same sign as the half wave for the lowest of the two peak current values. By in this way ensuring that the breaking takes place after completing of a so-called "short half wave" the arc energy developed in conventional breakers may be minimized when opening the current path, and it gets possible to carry out the breaking of the current at an earlier time than could possibly otherwise be conceivable should there be a risk of breaking during a "long half wave". The lower arc energy results in a longer electric life time or higher performance. In a hybrid breaker of the type described above this embodiment of the invention is even more attractive, since it means that said path, which may be a rectifying semiconductor device, such as a diode, does not have to be dimensioned to withstand the long half wave of the current. This means that said part may be made considerably cheaper.

According to another preferred embodiment of the invention the apparatus comprises members adapted to measure the time between two consecutive zero-crossings of the alternating current detected by said detecting members after occurrence of the fault current, members are adapted to compare this period of time with the period time of the alternating current, and the unit is adapted to control the switching device to break the current directly after a future half wave corresponding to said half wave and defined by two zero-crossings separated by a time interval below a predetermined portion of the period time of the alternating current. By measuring the period time between consecutive zero-crossings of the alternating current in this way it is possible to determine the degree of asymmetry of the alternating current after occurrence of the fault current and control the electric switching device to break the current in the current path when this is most appropriate in the individual case. Said comparison with a period time of the alternating current may very well be purely imaginary, and it may be predetermined that at a said time interval shorter than a determined time interval the electric switching device is to be controlled to open the current path, in which the predetermination of such a limit time has initially been made with of the period time of the alternating current.

According to another preferred embodiment of the invention the unit is adapted to control the switching device to open during a half period having a said time interval below 50% of the period time of the alternating current. The advantages of ensuring that the opening takes place during the so-called "short half wave" in this way appear without doubt from the discussion above of another preferred embodiment of the invention.

According to another preferred embodiment of the invention the apparatus comprises members adapted to calculate a delay time for opening the switching device on the basis of the size of said proportion and the length of the time since the fault current occurred, which makes it possible to carry out the opening of the switching device and thereby breaking of the current earlier if said proportion is small, since this will mean a short arcing time for a conventional breaker and a low current through said part of a so-called hybrid breaker of the type mentioned above, despite the fact that the dc-level of the alternating current is then still comparatively high.

The apparatus is according to another preferred embodiment of the invention adapted for breaking the current in the current path to cause control of an electric switching device comprising two branches connected in parallel in the current path, in which the first one comprises a first contact member having two contacts movable with respect to each other for opening and closing and the second comprises a part with ability to block current therethrough in at least a blocking direction and conduct current therethrough in at least one direction, in which a second contact member having two contacts movable with respect to each other for opening and closing is connected in series with said part, and in which the switching device also comprises a unit adapted to control breaking of the current in said current path on the basis of said current detection by controlling the first contact member to open for transferring the current to said part when this is in or going into a conducting state and then the second contact member to open when said part is in a state of blocking current therethrough after a zero-crossing of the alternating current for breaking the current through the switching device directly after a said half wave and making the breaking permanent. As already mentioned before this enables a maximum saving of said part, such as a diode, and a breaking of the current at the earliest possible time. This is also valid for an apparatus according to the appended claim 21, which is designed for controlling an electric switching device of the type described in the applicant's Swedish patent application 9904166-7 still not available to the public.

According to another preferred embodiment of the invention the apparatus comprises a separately controllable electric switching device arranged in the current path for the respective phase for an alternating current in the form of a multiple phase alternating current, members are adapted to determine the time for breaking the current in the current path of the respective phase individually for each phase of the alternating current on the basis of values of the alternating current detected after occurrence of said fault for individual, independent opening each individual switching device and thereby breaking the phase current. Hereby it will be possible to break the phase current of the phases having a small dc-component comparatively early, but also phases having a considerable dc-component of the current may be subjected to a comparatively early opening of the electric switching device in question by completing the breaking of the current after a so called "short half wave".

According to a preferred embodiment of the invention the apparatus comprises an electrically controlled driving member adapted to obtain opening of the electric switching device, and it is particularly advantageous when this driving member is an electromagnetic machine in the form of an electric motor. By using such a driving member it will be possible to very accurately control the movement of one or more movable parts of the electric switching device and ensure that the separation of two contacts takes place at a quite particular phase position of the alternating current, so that the breaking is completed directly after said half wave of the alternating current desired. Further advantages arise when the control unit of the apparatus in the form of an electronic unit is adapted to control the driving member. This embodiment is suited for co-ordination with a prediction of a future development of the current through the switching device, such as a future zero-crossing of the current, for co-ordinating a breaking of the current with such a prediction, so as to ensure that for example a semiconductor device with ability to block current only will conduct current during a so called short half wave.

The invention also relates to advantageous uses of an apparatus as above in accordance with the appended use claims.

The invention also relates to an arrangement, a computer program as well as the computer program product according to the corresponding appended claims. It is easily understood that the method according to the invention defined in the appended set of method claims is well suited to be carried out through program instructions from a processor that may be influenced by a computer program provided with the program steps in question. Although not explicitly expressed in claims, the invention comprises such arrangements, computer programs and computer program products combined with a method according to any of the appended method claims.

Further advantages as well as advantageous features of the invention appear from the following description and the other dependent claims.

BRIEF DESCRIPTION OF THE DRAWINGS

With reference to the appended drawings, below follows a specific description of a preferred embodiment of the invention cited as an example.

In the drawings.

DETAILED DESCRIPTION OF A PREFERRED EMBODIMENT OF THE INVENTION

Figure 4:
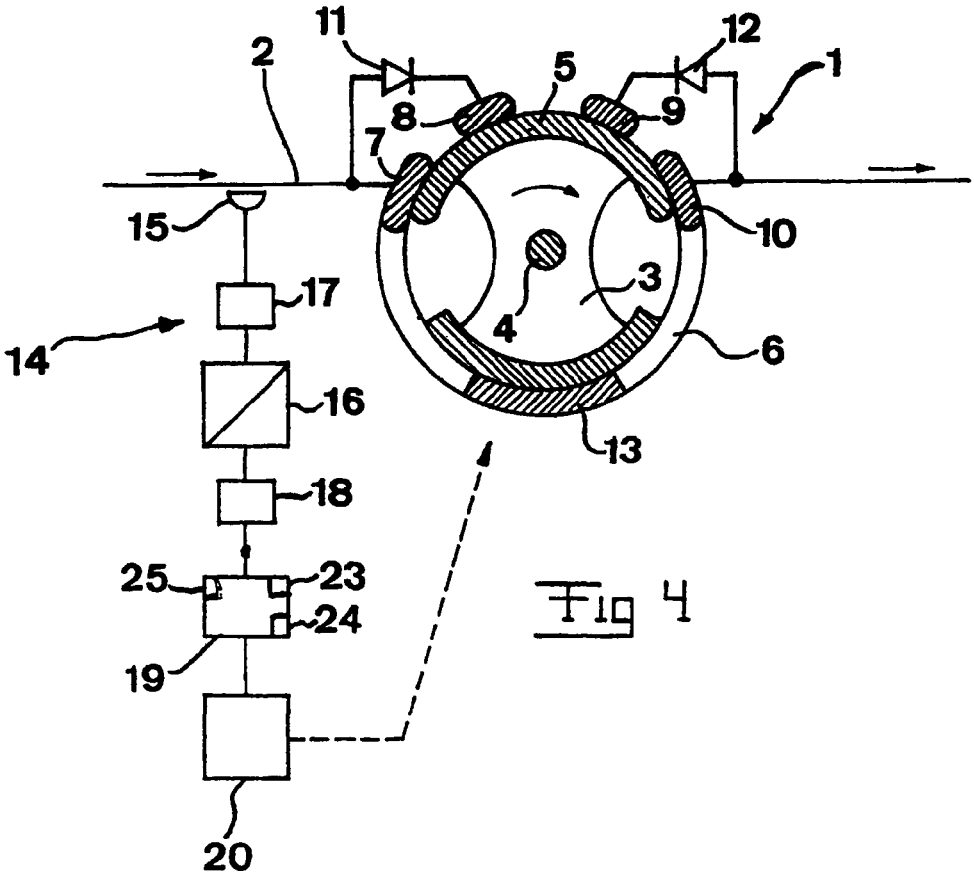
FIGS. 4–6 are simplified views illustrating an apparatus for controlling an electric switching device for alternating current arranged in a current path according to a preferred embodiment of the invention.
Figure 5:
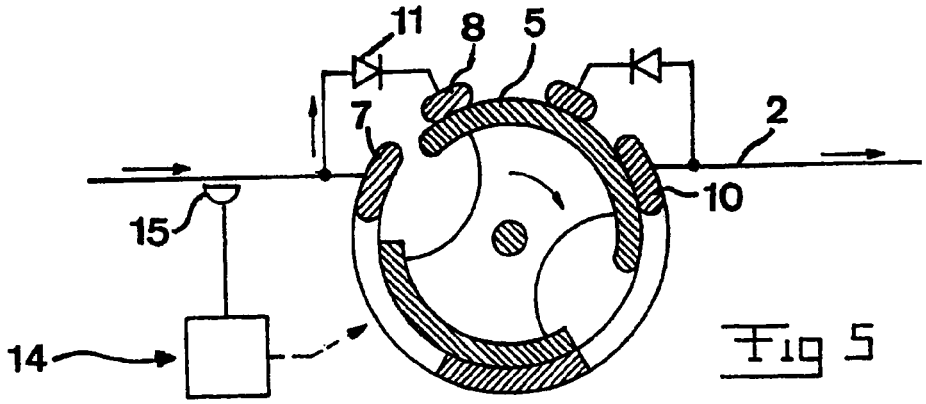

The construction and the function of a hybrid breaker of the type described in the Swedish patent application 9904164-2 mentioned above will now first of all be briefly described for making it easier to understand the invention and since the invention has quite particular advantages for exactly such an electric switching device. The description is made while referring to FIGS. 4–6.

The electric switching device is connected in a current path 2 for being able to rapidly break a current therein by opening it. One such switching device is arranged per phase, so that a three-phase network has three such switching devices on one and the same location. The switching device has an inner cylinder 3, which may be rotated about an axle 4 and has a movable contact part 5. A second cylinder 6 is arranged externally of the cylinder 3 and has four contacts 7–10 arranged along the movement path of the movable part 5 and adapted to form good electric contacts when bearing against the movable part 5. The switching device is connected in the current path through the two outer contacts 7 and 10, respectively.

A semiconductor device in the form of a diode 11, 12 is connected between the two outer contacts and the adjacent inner contact next thereto with the conducting direction from the outer to the adjacent contact. The diodes could just as well both be directed with the conducting direction towards the outer contact.

The switching device has also a driving arrangement adapted to drive the inner cylinder 3 to rotate for movement of the movable contact part 5 with respect to the second contacts 7–10. The driving arrangement is in this case constituted by an integrated electric motor 13 being schematically indicated and which may be of many different types.

An apparatus 14 according to the invention for controlling the electric switching device is connected thereto. The apparatus has members 15 schematically indicated adapted to detect the current in the current path by detecting the direction and the magnitude thereof and thereby also detect the time for a zero-crossing of the current. The detecting members are adapted to send signals with information about the current further to an analogous/digital-converter 16 for converting the analogous signals to digital signals. Filters 17, 18 are arranged in the signal path before and after the converter for filtering out noise signals, especially high frequency noise signals, from the signals from the detecting members 15. The current information is sent further to means 19 adapted to carry out calculations on the basis of values of the current detected by the detecting members used for determining the time for breaking the current in the current path by opening the electric switching device controlled by a unit 20.

The control unit 20 is here constituted by an electronic unit adapted to control an electrically controlled driving member 13 in the form of an electric motor to drive the movable part 5 to rotate around the axle 4. By using such an electrically controlled driving member in the form of an electric motor and an electronic unit for co-ordination therewith, the movement of the movable part 5 may be controlled very accurately and it may be ensured that the breaking of the current really takes place when this is desired, i.e. directly after a said half wave. A co-ordination with a prediction of a future zero-crossing of the current may well be done, if such an electric motor and an electronic unit are used.

The means may be designed to calculate a suitable time for breaking the current in the current path in different ways, which will be described further below.

Figure 1:
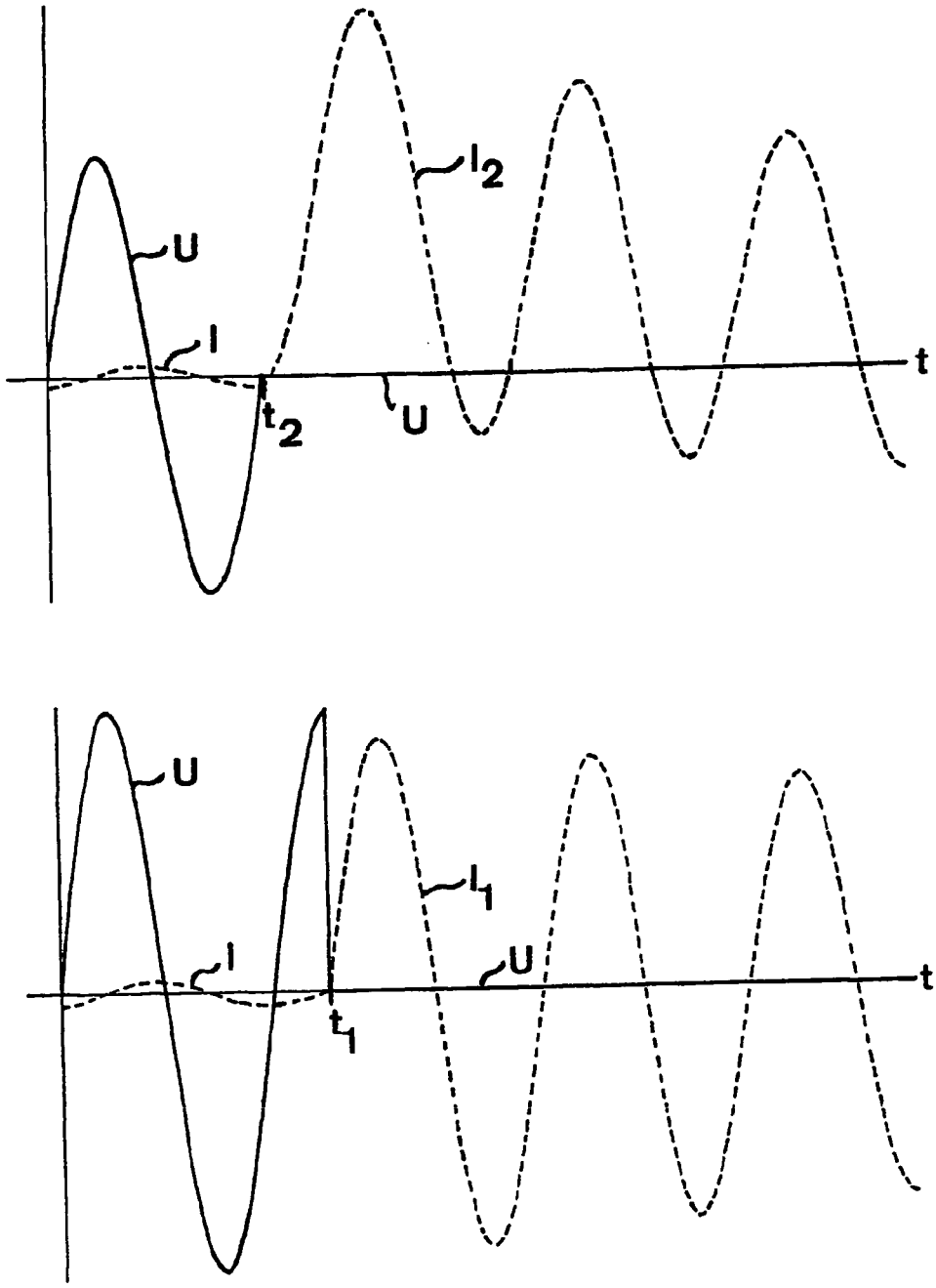
FIG. 1 is a graph illustrating the development of the voltage U and the current I with time to the time for occurrence of a short-circuiting along a current path and the development of the current with time after such a short-circuiting for two different short-circuiting times, FIG. 2 schematically illustrates the total current and the development of the dc-component with time after occurrence of a short-circuiting with a maximum asymmetry.
Figure 2:
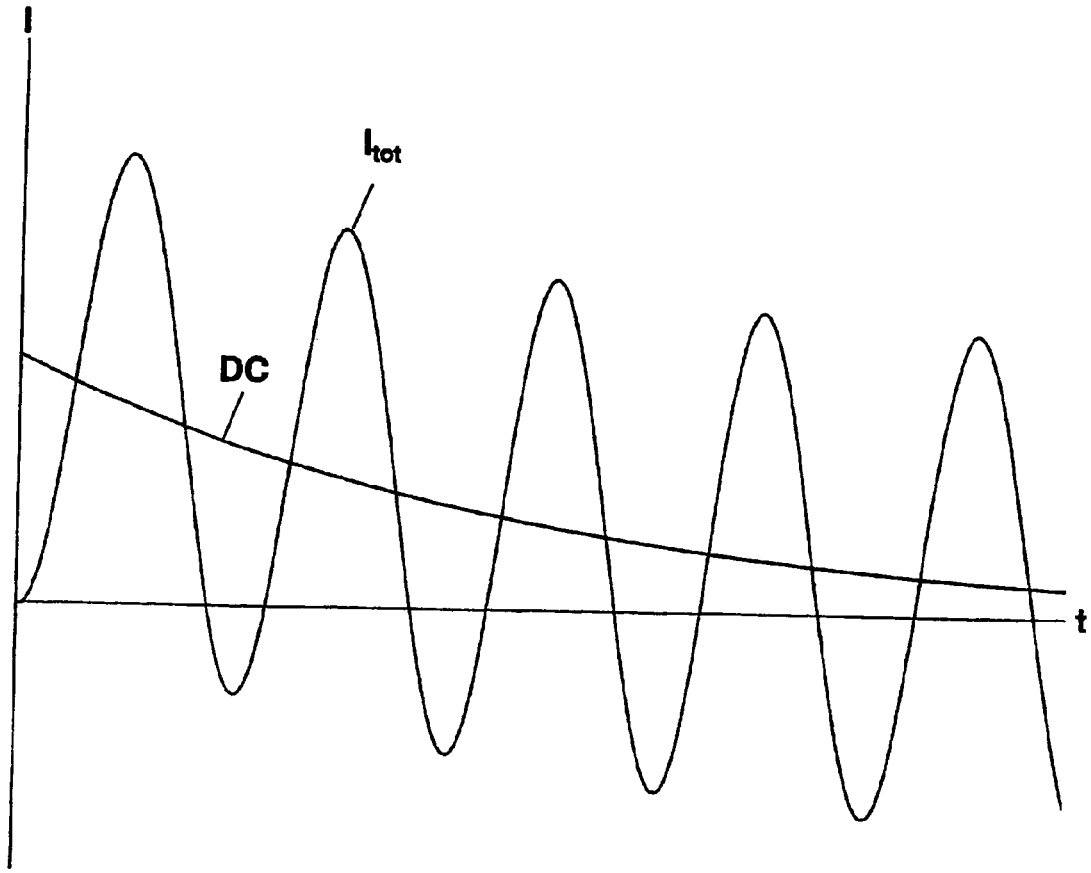

The function of a switching device of the type illustrated appears more in detail from the Swedish patent application 9904164-2 mentioned above, but it will here be briefly summarized: when a desire to break the current in the current path 2 arises, for example by the fact that the detecting members 15 detect a very high current in the current path 2, which may be caused by a short-circuiting therealong, it will then be possible to detect the direction of the alternating current and make the rotation direction of the cylinder 3 and thereby of the movable contact part 5 depending thereupon for obtaining the quickest possible breaking, but a very high accuracy at the very breaking is in the present invention given priority with respect to being as quick as possible. The entire current through the switching device flows in the closed position according to FIG. 4 between the two outer contacts 7, 10 through the movable part 5 interconnecting them galvanically. Assuming that a decision has been taken to carry out the breaking by rotating the inner cylinder 3 clockwise as seen in FIG. 1. This shall then preferably be done so that an opening of the contact member formed by the contacts 7 and 8 is made through a zero-crossing of the current, so that this may take place without forming any noticeable arc. This shall take place when the diode is going to be forward biased, so that the current is then switched over to the diode 11 instead.

Figure 6:
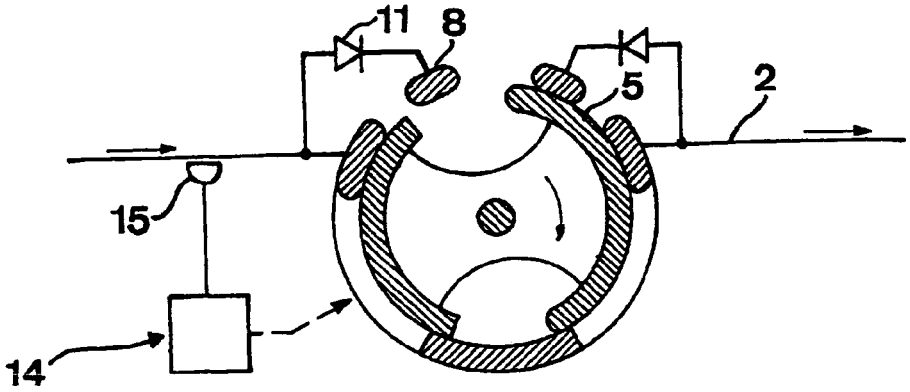

When then the voltage across the switching device changes direction no current will flow therethrough, but a voltage will be built up over the diode 11 then reverse biased and the rotation movement of the movable contact part is now continued in the same direction as before, so that the galvanic connection between the contact 8 and the contact 10 is broken and the breaking of the current is thereby made permanent. This breaking may take place without any arcing, since no current flows through the contact spot. The completely open position shown in FIG. 6 is hereby obtained, in which the current is permanently broken.

Said means 19 have as main task to determine whether the alternating current is present in a so-called main wave (long half wave) or small wave (short half wave) and ensure that the breaking of the current in the current path of the phase in question is completed after a short half wave. This is the basic idea which, however, sometimes is abandoned. It is most important that it is ensured that the breaking never takes place after a long half wave of a phase having a great asymmetry of the alternating current, so that the diodes 11, 12 do not have to be dimensioned to take such peak currents which may then occur. However, in a nearly symmetrical alternating current of any phase the opening could mostly take place after any of the half waves, so that said means is preferably adapted to measure a period of time between two consecutive zero-crossings of the alternating current detected by said detecting member after occurrence of the fault and compare this period of time with the period time of the alternating current, and the unit is adapted to control the switching device to break the current after a future half wave corresponding to a said half wave and defined by two zero-crossings separated by a time interval below a predetermined proportion of the period time of the alternating current. Thus, this proportion may be somewhat larger than 50%, for example up to 55% may be accepted. However, this means that it is ensured that at great asymmetries the completing of the breaking always takes place after a short half wave.

However, it would be well possible to arrange means 23 for calculating a suitable time for breaking the current in the current path by comparing the peak current values of the alternating current with a predetermined current limit value and/or with consecutive such peak current values for deciding whether the peak current is sufficiently low for allowing breaking after a long half wave or which half wave is the short one for determining the breaking after such a half wave instead of measuring the time between consecutive zero-crossings.

Figure 3:
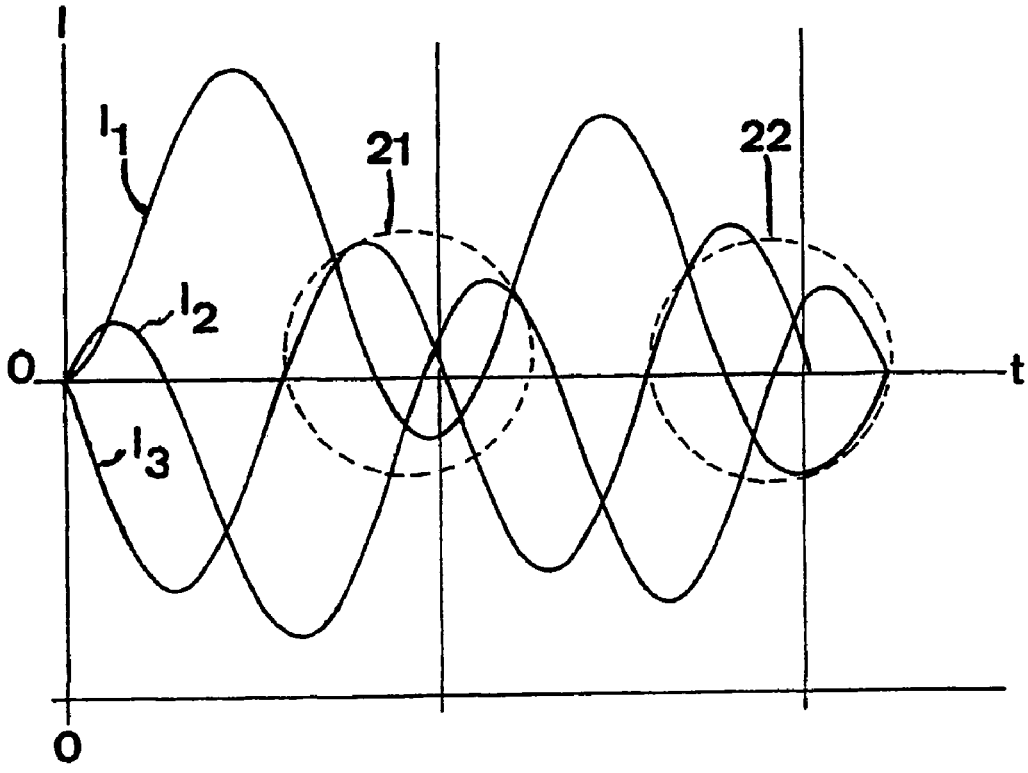
FIG. 3 illustrates the development of the alternating current of three different phases of a three phase alternating current network after occurrence of a fault, such as a short-circuiting, along the current path and where the opening of the electric switching devices for the respective phase according to the invention should be advantageously carried out.

A possible case of development of the alternating currents $l_1$, $l_2$ and $l_3$ of three phases after occurrence of a fault at the time 0 is illustrated in FIG. 3. It appears that all three phase currents have considerable asymmetries, so that it is important to cause commutation of the current through the diode in question during a short half wave and complete the breaking after the same. The circles 21, 22 are possible time intervals for causing a breaking of the three phases shown. However, it is pointed out that the asymmetry of each phase current, i.e. the dc-component thereof, decreases with time at the same time as an ac-decay exists, and this is also considered when determining within which circle the breaking takes place. By opening a conventional breaker and break the current after a short half wave in the respective phase an optimum arcing time is obtained and in the hybrid breaker as above a low current through said part, above the diode 11, is obtained when breaking the current in the current path. The delay introduced by the method according to the invention gets for a period of time of the alternating current of 20 ms maximally exactly this period time. This means in the practice that for an electric switching device of the type shown in FIGS. 4–6 the diodes 11, 12 do not have to be dimensioned for withstanding the long half wave of the current. For a 25 kA-breaker this would for example mean that the diode only has to withstand a peak current in the order of 35 kA instead of 50 kA, which of course results in a considerable saving of costs.

Figure 7:
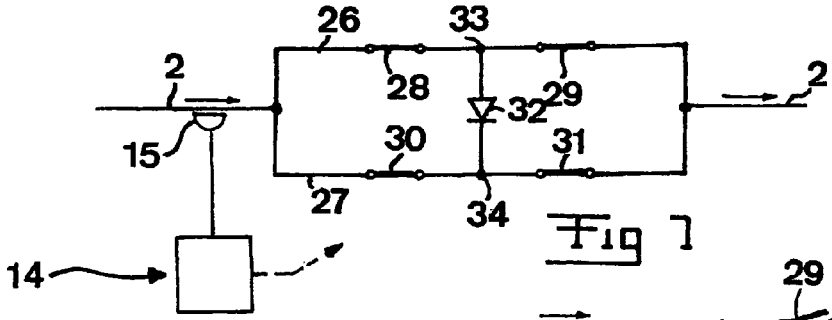
FIGS. 7–9 are simplified circuit diagrams illustrating an apparatus for controlling an electric switching device for alternating current arranged in a current path in a closed, temporary closed and open position, respectively.

The general construction of an electric switching device according to the Swedish patent application 9904166-7 mentioned above is schematically illustrated in FIG. 7 and this is connected in a current path 2 for being able to open and close this rapidly. One such switching device is then arranged per phase, so that a three-phase network has three such switching devices on one and the same location. The switching device comprises two branches 26, 27 connected in parallel in the current path and having each at least two mechanical contact members 28–31 connected in series. A semiconductor device 32 in the form of a diode is arranged to interconnect the midpoints 33, 34 between the two contact members of each branch.

An apparatus 14 according to the invention for controlling the electric switching device is connected thereto and the construction thereof is the same as described above for the embodiment according to FIGS. 4–6.

The function of the electric switching device is as follows: when a desire to break the current in the current path 2 occurs, for example by the fact that the detecting member 15 detects a very high current in the current path, which may be caused by a short-circuiting therealong, it is determined in the way described above through the result of the detection when it is suitable to break the current through the respective electric switching device. Once it has been determined that a given electric switching device shall be opened, the control unit 20 first takes a decision which two contact members, here the-contact members 29 and 30 (see FIG. 8), are to be opened for establishing a temporary current path through the semiconductor device 32. Thus, this decision is made dependent upon in which position the current in the current path is located in that moment. The entire current through the switching device flows in the position according to FIG. 7 through the two branches 26, 27 and nothing through the diode. When the breaking now shall take place the current shall as quick as possible be transferred to flow through the diode instead. The current may be switched in to the diode from a certain direction during that part of an alternating current period which is located between the time shortly before the diode gets forward biased in that direction and the time when the diode gets reverse biased next time. This means for a full period of 20 ms in the practice that an opening of the contact member according to FIG. 8 may take place for example about 2 ms before zero-crossing towards the forward biased direction and until the next zero-crossing. When the wrong half period of the alternating current for opening the contact members 29 and 30 according to these premises is present, the contact members 28 and 31 may instead immediately be opened for establishing the temporary current path instead. Accordingly, this temporary current path may be established immediately after detecting a need of and possibility to open the switching device or closing the current therethrough.

Figure 8:
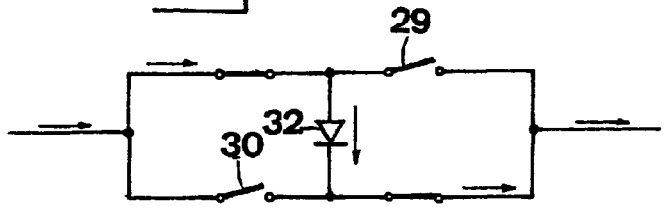

When the temporary closed position illustrated in FIG. 8 is obtained by opening the contact members 29, 30 a small spark is created in the gap between the contacts of the respective contact member, which results in a voltage of usually 12–15 V, which will drive the transfer of the current through the diode 32.

Figure 9:
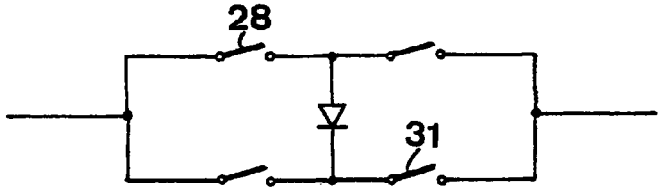

When then the current across the switching device changes direction no current will flow therethrough, but a voltage will be built up across the diode 32 then reverse biased, and at least one of the two other contact members 28, 31 is now opened, so that the temporary current path is opened, in which this opening may take place without any arcing, since no current flows through the contact spot at the occasion for the opening. The completely opened position of the switching device shown in FIG. 9 is thereby obtained, in which the current therethrough is permanently broken. It is for this terminating opening important that it takes place so quickly that the voltage across the diode 32 may not change direction again and the diode then starts to conduct. The utilization of the same semiconductor device in the temporary current path independently of in which direction the current then flows through the switching device enables large savings of costs by a considerably reduced number of semiconductor devices with respect to switching devices of this type already known.

The invention is particularly well suited for a multiple phase alternating current with a separately controllable electric switching device arranged in the current path for the respective phase, since a breaking of the different phases may take place at times suitable for each phase.

An apparatus according to the invention is advantageously used for controlling an electric switching device in a current path in switch gears for electricity supply within the industry or in distribution or transmission networks, and the voltage of the current path is then preferably on intermediate voltage level, i.e. between 1 and 52 kV. However, the invention is not restricted to alternating voltages on these levels.

Furthermore, the invention is particularly applicable to electric switching devices adapted to take an operation current of 1 kA, preferably 2 kA.

The invention of course not in any way restricted to the preferred embodiments described above, but many possibilities to modifications thereof will be apparent to a person with skill in the art without departing from the basic idea of the invention as defined in the appended claims.

The invention is, as already mentioned, applicable to all types of electric switching devices having a breaking function.

The invention claimed is:

1. A method for controlling an electric switching device for alternating current arranged in a current path for opening this device for breaking the current in the current path after occurrence of a fault current in the current path, wherein the current in the current path is detected and the electric switching device is controlled to break the current in the current path directly after a half wave of the alternating current having a peak current below a predetermined current limit value, so that the breaking is completed at a zero-crossing of the alternating current terminating a said half wave; and wherein a peak current value is determined through said current detection of two consecutive half waves of the alternating current after occurrence of the fault current and these peak current values are compared with each other, and that the switching device is controlled to break the current in the current path after a half wave of the alternating current corresponding to said half wave with the same sign as the half wave for the lowest of the peak current values and complete the breaking at a zero crossing of the alternating current after a said half wave.

2. A method according to claim 1, wherein at least one peak current value is determined on the basis of the detection of the current and this value is compared with said predetermined current limit value for controlling the opening of the switching device on the basis of this comparison.

3. A computer program product for carrying out the steps of claim 1, being loadable directly into the internal memory of a digital computer and comprising software code portions for carrying out the steps when the product is run on a computer.

4. A method according to claim 1, wherein the period of time between consecutive zero-crossings of the alternating current after occurrence of the fault current is measured, that this period of time is compared with the period time of the alternating current, and that the switching device is controlled to break the current directly after a coming half wave corresponding to said half wave and defined by two zero-crossings separated by a time interval below a predetermined proportion of the period time of the alternating time.

5. A method according to claim 4, wherein said proportion is 55%.

6. A method according to claim 4, wherein said proportion is 50%.

7. A method according to claim 1, wherein a delay time for opening the switching device is calculated on the basis of the size of said proportion and the length of the time since the fault current occurred.

8. A method according to claim 7, wherein said half wave for opening the switching device is selected in dependence of the size of said proportion in such a way that said delay time tends to be reduced when the proportion is reduced.

9. A method according to claim 1, wherein the control for breaking the current in the current path is carried out for an electric switching device comprising two branches connected in parallel in the current path, in which a first one of them comprises a first contact member having two movable contacts movable with respect to each other for opening and closing and the second one comprising a part with ability to block current therethrough in at least one blocking direction and conduct current therethrough in at least one direction, in which a second contact member having two contacts movable with respect to each other for opening and closing is connected in series with said part, and in which the switching device also comprises a unit adapted to control breaking of the current in said current path on the basis of said current detection by controlling the first contact member to open for transferring the current to said part when this is in or going into a conducting state and then the second contact member to open when said part is in a state of blocking current therethrough after a zero-crossing of the alternating current for breaking the current through the switching device directly after a said half wave and making the breaking permanent.

10. A method according to claim 1, wherein the control carried out for breaking the current in the current path is carried out for an electric switching device having at least two contact members arranged in a current path through the switching device and a semiconductor device with ability to block current therethrough in at least a first blocking direction and a unit adapted to control opening of a current path through the switching device by controlling a first of the contact members to open for transferring the current through the switching device to the semiconductor device when this is in or going into a conducting state and then the second contact member to open when the semiconductor device is in a state of blocking current therethrough for making the breaking of the current through the switching device permanent, that the current path has two branches connected in parallel between a first and a second end of the switching device and cross-connected with each other through the semiconductor device, that the direction and the magnitude of the current through the switching device is detected, that for said breaking of the current in the current path through the switching device firstly both branches are opened, one before as seen from said first end and the other after as seen from the first end the connection of the respective branch to the semiconductor device, in which which of the branches is opened before and which of them is opened after said connection is made dependent upon the detection of the current, so that the current is transferred to a temporary current path between said two ends through a part of one branch, the semiconductor device and a part of the other branch when the semiconductor device is in or going into a conducting state and the breaking of the current through the switching device is then made permanent when the semiconductor device is in a state of blocking current therethrough by opening said temporary current path, and that the breaking of the current of the current path is controlled to be completed at a zero-crossing of the alternating current terminating a said half wave.

11. A method according to claim 1, in which the alternating current is a multiple phase alternating current and one separately controllable electric switching device is arranged in said current path for the respective phase, characterized in that the time for a breaking of the current in the current path of the respective phase is determined individually for each phase of the alternating current for individually, independently open each individual switching device and thereby breaking the phase current.

12. An apparatus for controlling an electric switching device for alternating current arranged in a current path for opening the switching device for breaking the current in the current path after occurrence of a fault current in the current path, comprising members adapted to detect the current in the current path and a unit adapted to control the electric switching device to break the current in the current path directly after a half wave of the alternating current having a peak current below a predetermined current limit value, so that the breaking is completed at a zero-crossing of the alternating current terminating a said half wave; and means adapted to determine a peak current value of two consecutive half waves of the alternating current after occurrence of a fault current on the basis of values of the current obtained through said current detection and compare these peak current values with each other, and that the unit is adapted to control the switching device to break the current in the current path directly after a half wave of the alternating current corresponding to said half wave and having the same sign as the half wave for the lowest of the two peak current values and complete the breaking at a zero-crossing of the alternating current terminating a said half wave.

13. An apparatus according to claim 12, further comprising means adapted to determine at least a peak current value on the basis of the current detected by said members and compare this value with said predetermined current limit value, and that the unit is adapted to control the opening of the switching device in dependence of the result of this comparison.

14. A use of an apparatus according to claim 12 for controlling an electric switching device adapted to take an operation current of 1 kA, preferably at least 2 kA.

15. An apparatus according to claim 12, comprising members adapted to measure the period of time between two consecutive zero-crossings of the alternating current detected by said detecting members after occurrence of the fault current, that members are adapted to compare this period of time with the period time of the alternating current, and that the unit is adapted to control the switching device to break the current directly after a future half wave corresponding to said half wave and defined by two zero-crossings separated by a time interval below a predetermined portion of the period time of the alternating current.

16. An apparatus according to claim 15, wherein the unit is adapted to control the switching device to break the current directly after a half wave with a said time interval below 55% of the period time of the alternating current.

17. An apparatus according to claim 15, wherein the unit is adapted to control the switching device to break the current directly after a half wave having a said time interval below 50% of the period time of the alternating current.

18. An apparatus according to claim 15, comprising members adapted to calculate a delay time for opening the switching device on the basis of the size of said proportion and the length of time since the fault current occurred.

19. An apparatus according to claim 18, wherein said members are adapted to calculate and determine said half wave for opening the switching device in dependence of the size of said proportion in such a way that said delay time tends to be reduced when the proportion decreases.

20. An apparatus according to claim 12, wherein it is adapted to break the current in a current path by controlling an electric switching device comprising two branches connected in parallel in the current path, in which the first one comprises a first contact member having two contacts movable with respect to each other for opening and closing and the second comprises a part with ability to block current therethrough in at least a blocking direction and conduct current therethrough in at least one direction, in which a second contact member having two contacts movable with respect to each other for opening and closing is connected in series with said part, and in which the switching device also comprises a unit adapted to control breaking of the current in said current path on the basis of said current detection by controlling the first contact member to open for transferring the current to said part when this is in or going into a conducting state and then the second contact member to open when said part is in a state of blocking current therethrough after a zero-crossing of the alternating current for breaking the current through the switching device directly after a said half wave and making the breaking permanent.

21. An apparatus according to claim 12, wherein it is adapted to break the current in the current path by controlling an electric switching device comprising at least two contact members arranged in a current path through the switching device and a semiconductor device with ability to block current therethrough in at least a first blocking direction and a unit adapted to control breaking of a current in a current path through the switching device by controlling a first of the contact members to open for transferring the current through the switching device to the semiconductor device when this is in or going into a conducting state and then the second member to open when the semiconductor device is in a state of blocking current therethrough for making the breaking of the current through the switching device permanent, that the total number of contact members of the switching device is at least four with two connected in series in each of two branches connected in parallel in said current path, that the semiconductor device is adapted to connect the midpoints between the two contact members of each branch to each other, that the switching device comprises at least one member adapted to detect the direction of the currents through the switching device, that the control unit is adapted to control breaking of the current in the current path by controlling a first contact member of one first of the branches located before said midpoint with respect to the current direction prevailing to open and a second contact member of the second branch located after the midpoint as seen in the current direction to open for transferring the current to a temporary current path through the semiconductor device when this is in or going into a conducting state and then make the breaking of the current in the current path through the switching device permanent when the semiconductor device is in a state of blocking the current therethrough by opening at least one contact member of the switching device arranged in the temporary current path through the semiconductor device, and that the control unit is adapted to select which branch is to be the first on the basis of information from the current detecting member and to control the breaking of the current in the current path in dependence of the result of said current detection, so that it is completed at a zero-crossing of the alternating current terminating a said half wave.

22. An apparatus according to claim 12, wherein the alternating current is a multiple phase alternating current and one separately controllable electric switching device is arranged in said current path for the respective phase, characterized in that it comprises members adapted to determine the time for breaking the current in the current path of the respective phase individually for each phase of the alternating current on the basis of values of the alternating current detected after occurrence of said fault for individually, independently open each individual switching device and thereby breaking the phase current.

23. An apparatus according to claim 12, comprising an electrically controlled driving member adapted to carry out the opening of the electric switching device.

24. An apparatus according to claim 23, wherein the driving member is an electromagnetic machine.

25. An apparatus according to claim 24, wherein the driving member is an electric motor.

26. An apparatus according to claim 23, comprising a control unit in the form of an electronic unit adapted to control said driving member.

27. A use of an apparatus according to claim 12 for controlling an electric switching device in a current path in a switchgear for electricity supply within industry or in distribution or transmission networks.

28. A use of an apparatus according to claim 12 for controlling an electric switching device in a current path adapted to have a voltage between 1–52 kV.

29. An arrangement for controlling an electric switching device for alternating current arranged in a current path for opening the latter for breaking the current in the current path after occurrence of a fault current in the current path, said arrangement comprising a program module containing at least one processor adapted to carry out program instructions to detect the current in the current path and to control the electric switching device to break the current in the current path directly after a half wave of the alternating current having a peak current below a predetermined current limit value, so that the breaking is completed at a zero-crossing of the alternating current terminating a said half wave; and a program module adapted to determine a peak current value of two consecutive half waves of the alternating current after occurrence of a fault current on the basis of values of the current obtained through said current detection and compare these peak current values with each other, and that the unit is adapted to control the switching device to break the current in the current path directly after a half wave of the alternating current corresponding to said half wave and having the same as the half wave for the lowest of the two peak current values and complete the breaking at a zero-crossing of the alternating current terminating a said half wave.

30. A computer program for controlling an electric switching device for alternating current arranged in a current path for opening this device for breaking the current in the current path after occurrence of a fault current in the current path, said computer program comprising instructions for influencing a processor to cause detection of the current in the current path and controlling the electric switching device to break the current in the current path directly after a half wave of the alternating current having a peak current below a predetermined current limit value, so that the breaking is completed at a zero-crossing of the alternating current terminating a said half wave; and instructions adapted to determine a peak current value of two consecutive half waves of the alternating current after occurrence of a fault current on the basis of values of the current obtained through said current detection and compare these peak current values with each other, and that the unit is adapted to control the switching device to break the current in the current path directly after a half wave of the alternating current corresponding to said half wave and having the same sign as the half wave for the lowest of the two peak current values and complete the breaking at a zero-crossing of the alternating current terminating a said half wave.

31. A computer program according to claim 30, provided at least partially through a network.

* * * * *